US006185971B1

(12) United States Patent
Kuwano et al.

(10) Patent No.: US 6,185,971 B1
(45) Date of Patent: Feb. 13, 2001

(54) HOT ROLLED MATERIAL TAKE-UP EQUIPMENT AND TAKE-UP METHOD

(75) Inventors: Hiroaki Kuwano, Yokosuka; Hiroshi Takase; Hisashi Sato, both of Yokohama; Toshirou Matsushita, Yokosuka; Toshio Imazeki, Chiba; Taichi Kukizaki, Chiba; Kiyoshi Ueda, Chiba; Hideyuki Nikaido, Chiba, all of (JP)

(73) Assignees: Ishikawajima-Harima Heavy Industries Co., Ltd., Tokyo; Kawasaki Steel Corporation, Hyogo, both of (JP)

( * ) Notice: Under 35 U.S.C. 154(b), the term of this patent shall be extended for 0 days.

(21) Appl. No.: 09/171,944

(22) PCT Filed: Mar. 19, 1998

(86) PCT No.: PCT/JP98/01187

§ 371 Date: Oct. 29, 1998

§ 102(e) Date: Oct. 29, 1998

(87) PCT Pub. No.: WO99/24187

PCT Pub. Date: May 20, 1999

(30) Foreign Application Priority Data

Nov. 11, 1997 (JP) ..... 9-308743

(51) Int. Cl.[7] ..... B21B 39/08; B21B 39/20

(52) U.S. Cl. ..... 72/205; 72/250

(58) Field of Search ..... 72/203, 204, 205, 72/419, 420, 426, 428, 250

(56) References Cited

U.S. PATENT DOCUMENTS

| | | | | |
|---|---|---|---|---|
| 4,002,047 | * | 1/1977 | MacPhee et al. | 72/160 |
| 4,711,114 | * | 12/1987 | Rohde et al. | 72/203 |
| 5,560,236 | * | 10/1996 | Onda et al. | 72/203 |
| 5,860,311 | * | 1/1999 | Donini et al. | 72/250 |
| 5,966,978 | * | 10/1999 | Kneppe et al. | 72/203 |

* cited by examiner

*Primary Examiner*—Rodney A. Butler
(74) *Attorney, Agent, or Firm*—Griffin & Szipl, P.C.

(57) ABSTRACT

A take-up equipment and a take-up method for a finish rolling mill for dividing a strip into a plurality of coiled products when taking up the strip on the exit side of the finish rolling mill are provided. A plurality of take-up machines (24, 26, $K_1$, $K_2$) are disposed at the downstream side of a hot finish rolling mill; a shearing machine (27, 2) is provided on the upstream side of a pinch roll (23, 4) of the take-up machines (24, $K_1$) at the uppermost stream end; and a strip passing device (28, 6*a*) is provided between the shearing machine and the pinch roll at the uppermost stream to prevent a strip from rising. The strip passing devices are guiding devices for restricting the height of the rise of the strip or the airflow suction type strip passing devices for drawing in a strip under suction using airflow. The plurality of take-up machines are down coilers or carousel type reels having two winding drums (66*a*, 66*b*).

18 Claims, 12 Drawing Sheets

HOT ROLLED MATERIAL TAKE-UP EQUIPMENT AND TAKE-UP METHOD

BACKGROUND OF THE INVENTION

1. Field of the Invention

The present invention relates to take-up equipment and a take-up method for a finish rolling mill for dividing a strip into a plurality of coiled products when taking up the strip on the exit side of the finish rolling mill.

An object of dividing the strip at the exit side of the finish rolling mill is to split the strip, which is made from a slab having heavy individual weight, into several lighter coils to permit easier handling. Another object is to divide the strip at the exit side of the finish rolling mill in order to accommodate it to so-called endless rolling in hot rolling wherein a plurality of strips are joined at the entrance side of the finish rolling mill by connecting the trailing ends of preceding strips to the leading ends of following strips to perform nonstop rolling. The take-up equipment and the take-up method in accordance with the present invention can be applied to fulfill both objects described above.

2. Description of Related Art

FIG. 1 is a schematic diagram showing conventional take-up equipment. In conventional hot rolling, a single slab has been batch-rolled to produce a single coil. As illustrated in FIG. 1, a strip 22 leaving a last stand 21 of a finish rolling mill travels on table rollers 30 to be taken up by a take-up equipment constituted by pinch rolls 23, 25, and down coilers 24, 26 so as to be finished as a coiled product. In this illustrated case, the two pinch rolls 23, 25 and the two down coilers 24, 26 alternately take up the strip.

Thus, the take-up equipment described above has been unable to handle divided materials that are taken up by dividing the strips at the exit side of a finish rolling mill or to take up an endless rolled material.

SUMMARY OF THE INVENTION

The present invention has been made with a view toward solving the problem described above. It is an object of the present invention to provide equipment and a method for taking up a hot-rolled material that make it possible to divide an uncut strip which has been rolled to a predetermined thickness at the exit side of a finish rolling mill and to take up the cut strips by a down coiler into a coiled product in taking up split materials or in taking up divided materials or in the endless hot rolling wherein a plurality of strips are joined and rolled. It is another object of the present invention to provide equipment and a method for taking up a hot-rolled material that permit a thin strip running fast to be taken up in a stable manner.

According to the present invention, there is provided equipment for taking up hot-rolled material, the equipment being equipped with: a plurality of take-up machines (24, 26, $K_1$, $K_2$) disposed at a downstream side of a hot finish rolling mill; a shearing machine (27, 2) provided on an upstream side of a pinch roll (23, 4) of the take-up machines (24, $K_1$) at the uppermost stream end; and a strip passing device (28, 6*a*) provided between the shearing machine and the pinch roll at the uppermost stream to prevent a strip from rising.

In a preferred embodiment of the present invention, a pinch roll (1) is provided at an entrance side end of the shearing machine (2), and strip passing devices (82, 83) for preventing a strip from rising are provided between the pinch roll (1) and the shearing machine (2). Further, a strip passing device (29, 6*b*) for preventing a strip from rising is also provided between the plurality of take-up machines.

Further, a pinch roll (3) is provided near an exit side of the shearing machine (2) and a strip passing device (84) for preventing a strip from rising is provided between the pinch roll and the shearing machine. The upper pinch rolls of the foregoing pinch rolls (23, 25, 1, 3, 4, 5) are adapted so that they can be moved toward or away from the lower ones by hydraulic cylinders. The strip passing devices (28, 29, 82, 83, 84) are guiding devices for restricting the rising height of a strip. Or, the strip passing devices (28, 29, 6*a*, 6*b*) are airflow suction type strip passing devices that draw in a strip under suction using airflow.

The constitution of the present invention described above can be applied also to a case where several coils are produced from a single strip or a case where a plurality of strips are joined and rolled in endless hot rolling in which the joined strip that has been rolled to a predetermined thickness at an exit side of a finish rolling mill is cut by a shearing machine provided on the upstream side of the pinch roll of a down coiler at the uppermost stream end, then the cut strips are taken up by a plurality of down coilers provided at the downstream side of the hot finish rolling mill thereby to produce coiled products.

In a preferred embodiment of the present invention, the plurality of take-up machines ($K_1$, $K_2$) are down coilers. A pinch roll (4) disposed on the entrance side of the coiler ($K_1$) other than the down coilers at the lowermost stream end of a line is equipped with a changing means for altering the advancing direction of a strip.

In a further preferred embodiment, the plurality of take-up machines have carousel type reels, each having two take-up drums (66*a*, 66*b*). The take-up drum (66*a*) located at a lowermost downstream portion of a pass line P is provided with a wrapper roll (67) while the other take-up drum (66*b*) located off the pass line P is provided with a snubber roll (68) which holds a trailing end. A swing type strip passing device (69) for drawing a strip in under suction using airflow is disposed between the other take-up drum (66*b*) and a pinch roll (64) positioned on the pass line P, and a strip trailing end guide (70) is provided between the downstream end of the strip passing device and the other take-up drum (66*b*).

In a further preferred embodiment of the present invention, only the strip passing devices (6*a*, 6*b*) disposed immediately before the entrance sides of the respective take-up machines employ the airflow suction type strip passing devices that draw a strip in under suction using airflow.

Strip passing guides (82, 83, 84, 85, 86*a*, 86*b*, 87, 88*a*, 88*b*) for guiding a strip along the pass line are provided above the pass line at the positions corresponding to points between the pinch rolls (4, 5) disposed at the entrance sides of the take-up machines ($K_1$, $K_2$) and the airflow suction type strip passing devices (6*a*, 6*b*) disposed immediately before the entrance side thereof, between the airflow suction type strip passing device (6*a*) and the pinch roll (3) disposed immediately before the entrance side thereof, and between the shearing machine (2) and the pinch rolls (1, 3) disposed at the exit sides and entrance sides, respectively.

she Strip passing guides (86*a*, 86*b*, 88*a*, 88*b*) provided between the pinch rolls (4, 5) disposed at the entrance sides of the take-up machines ($K_1$, $K_2$) and the airflow suction type strip passing devices (6*a*, 6*b*) disposed immediately before the entrance sides thereof are constituted by pinch roll introducing guides (86*a*, 88*a*) provided very closely to the pinch rolls (4, 5) and top guides (86*b*, 88*b*) separate therefrom. When the airflow suction type strip passing devices are retracted from the pass line, the top guides are placed in a position between the airflow suction type strip passing devices and the pass line to guide the leading end of a strip to the pinch roll introducing guides. When the airflow suction type strip passing devices are rested in the vicinity of the pass line where they can be put in operation, the top guides are retracted to the position between the airflow suction type strip passing devices and the pinch rolls or to the position away from the pass line.

Further according to the present invention, there is provided a method for taking up a hot-rolled material wherein: strip passing devices (86*a*, 86*b*, 88*a*, 88*b*) at entrance sides of pinch rolls upstream of the take-up machine are composed of the pinch roll introducing guides (86*a*, 88*a*) located very closely to the pinch rolls and the top guides (86*b*, 88*b*) which are separate therefrom; trailing ends of the top guides are placed at a higher level above the pass line than the pinch roll introducing guides until the leading end of a strip is wound onto a take-up machine, then, when the leading end has been wound onto the take-up machine, the trailing ends of the top guides are moved down to substantially the same level as the pinch roll introducing guides from the pass line to take up the strip.

According to this method, the winding roll of the take-up machine described above has a guide that substantially runs along the outer periphery of the coil wound around a mandrel. When a strip has been wound up around the mandrel, the guide presses the winding roll against the outer periphery of the coil in order to hold the trailing end of the strip.

Until a first leading end of the strip reaches the take-up machine, the airflow suction type strip passing devices (6*a*, 6*b*) are held away from the pass line; among the strip passing guides (86*a*, 86*b*, 88*a*, 88*b*) immediately before the pinch rolls at the entrance sides of the take-up machines, at least the one for taking up the article to be wound provides guidance to the pinch rolls, while the remaining strip passing guides are set at a high position above the pass line; after the leading end has been wound onto the take-up machine, at least the airflow suction type strip passing devices and the strip passing guides located on the upstream side from the pinch rolls disposed at the entrance side of the take-up machine which takes up the strip next are moved down close to the pass line to a predetermined height; and after cutting by the shearing machine, the strip can be supported under suction by the airflow suction type strip passing devices until the leading end of the following material reaches the take-up machine.

Other objects and advantages of the present invention will become apparent from the following description given in conjunction with the accompanying drawings.

BRIEF DESCRIPTION OF THE DRAWINGS

FIGS. 15A and 15B are schematic diagrams illustrating the layouts of a top guide and the strip passing device employed in the embodiment of the present invention, wherein FIG. 15A shows the layout in which the strip passing device has been retracted from a pass line and FIG. 15B shows the layout in which the strip passing device has been set in place to be ready for operation;

DESCRIPTION OF THE PREFERRED EMBODIMENTS

Figure 1:
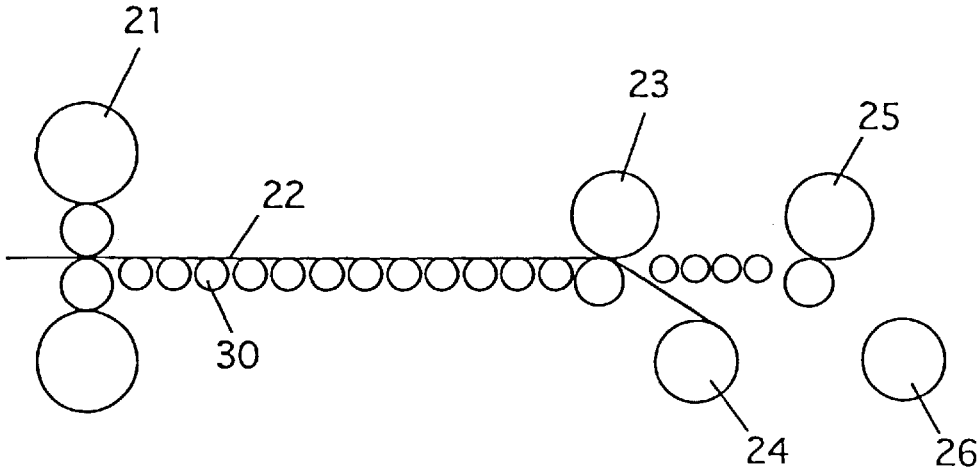
Fig. 1 (PRIOR ART)
FIG. 1 is a schematic diagram showing conventional take-up equipment.

Preferred embodiments of the present invention will now be described with reference to the accompanying drawings. The common parts in the drawings will be assigned like reference numerals and duplicate description thereof will be omitted.

Figure 2:
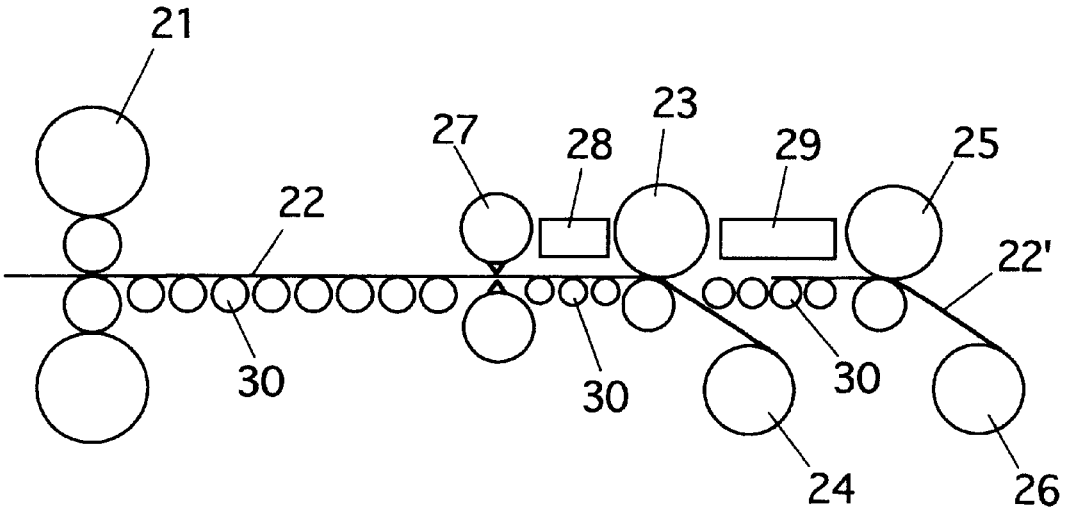
FIG. 2 is a general block diagram showing a first embodiment of the take-up equipment in accordance with the present invention.

FIG. 2 is a general block diagram showing a first embodiment of a take-up equipment in accordance with the present invention. As shown in the drawing, in the take-up equipment in accordance with the invention, a shearing machine 27 or a cutter for cutting a strip 22 or a rolled thin plate is installed between a last stand 21 of a finish rolling mill and a pinch roll 23 at the entrance side of a first down coiler 24, and a strip passing device 28 for preventing the strip 22 from rising is provided, on the exit side of the shearing machine 27, between the shearing machine 27 and the first pinch roll 23 so that it is opposed to table rollers 30. Further, another strip passing device 29 is provided between the first pinch roll 23 and a second pinch roll 25.

In this constitution, the strip is divided at the exit side of the finish rolling mill so that the strip made from a heavy slab is split into several lighter coils for easier handling.

In another example of the hot rolling equipment in accordance with the present invention, a plurality of strips are spliced by connecting the trailing end of a preceding strip with the leading end of a following strip at the entrance side of the finish rolling mill (not shown) so as to perform continuous rolling. One of the objects to splicing and rolling the strips in hot rolling is to ensure stabilized rolling operation of thin strips having a finished thickness of approximately 1 mm. The lower rigidity of thin strips makes it difficult to smoothly pass them through a rolling mill; the thin strips tend to meander because they lose tension at the moment the trailing ends thereof leave the rolling mill on the upstream side. The meander causes the strip to be caught up in a double layer in the rolling mill, leading to a danger of scratching a roll with resultant interruption of the rolling operation. There is another danger in that the leading end of a strip running on the table rollers after leaving the last stand of the finish rolling mill rises and fails to catch the pinch roll or leads to the interrupted transmission of the carrying force from the table rollers, disabling the transport. This case also poses the problem of interrupted rolling operation.

The aforesaid problems can be prevented by using the strips having a thickness suited to rolling for the first and last strips and splicing a plurality of thin strips that are less suited to the rolling between them for carrying out continuous rolling. This leads to less chances of the rise of the leading ends of a strip or the meander of the trailing end thereof. In this case, however, the strip has to be cut one by one upon the completion of the rolling and wound into coils. For this purpose, in the present invention, the shearing machine 27 is installed at the entrance side of the first pinch roll 23 on the exit side of the finish rolling mill. The strip 22 is cut into the separate strips by the shearing machine 27 and the strips are alternately taken up by two down coilers 24 and 26 in this example as illustrated in FIG. 2.

A concern in this case is how smoothly the thin strip 22 resulting from the cutting by the shearing machine 27 runs alone before reaching the first pinch roll 23 and how smoothly it runs alone before further reaching the second pinch roll 25. More specifically, since the strip having lower rigidity runs at high speed, there is the danger that the leading end thereof rises and fails to catch the pinch rolls 23 or 25, or the low rigidity causes an insufficient carrying force of the table rollers 30 and the pinch roll 23 to be transmitted to the strip 22, preventing the strip 22 from being carried. To prevent this problem, according to the present invention, the strip passing devices 28 and 29 for preventing the strip 22 from rising are provided between the shearing machine 27 and the pinch roll 23 on the uppermost upstream side and between the pinch rolls 23 and 25 of the down coiler, respectively.

Figure 3:
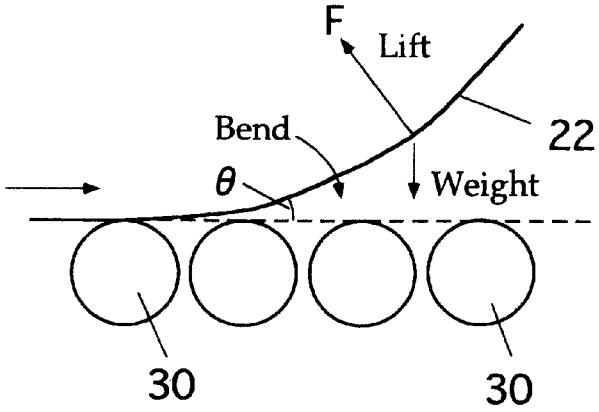
FIG. 3 is a schematic representation of the rise of a strip.

FIG. 3 is a schematic representation of the rise of a strip. As shown in this drawing, if the leading end of the strip 22 running on the table rollers 30 bumps against the table rollers 30 and rises, then the strip 22 continues running with the leading end up in some cases when the wind pressure, the weight of the rising strip 22, and the bending force are balanced. Especially when running the thin strip 22 at high speed, the weight of the strip and the bending force are reduced, making the leading end more likely to rise.

As shown in FIG. 3, when the elevation angle of the strip leading end is denoted as θ, the relationship between lift F of the strip caused by the wind pressure and the elevation angle θ is expressed as F  sin θ·sin2 θ. More specifically, lift F increases in proportion to sin θ·sin2θ; hence, unless elevation angle θ grows to a certain magnitude, lift F that causes the strip 22 to keep on rising against the weight and bend of the strip 22 is not generated.

Figure 4:
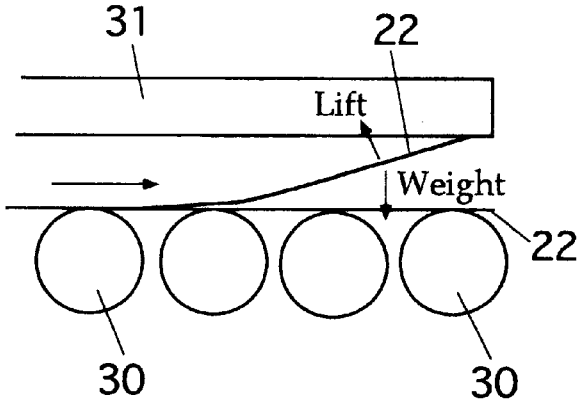
FIG. 4 is a diagram showing a first embodiment of a strip passing device.

FIG. 4 shows a first embodiment of the strip passing device. From the description given above, a guiding device 31 shown in FIG. 4 provides a possible choice as the strip passing devices 28 and 29 for preventing the leading end of the strip 22 from rising; it is a plate that is installed above the top surface of the strip 22 so that it is opposed to the table rollers 30 to restrict the rising height of the strip 22. When the rising height of the strip 22 is restricted by the guide 31 installed above, even if the leading end of the strip 22 rises from bumping against the table rollers 30, the elevation angle θ is controlled to a minimum. As a result, lift F is minimized, eliminating the chance of the leading end of the strip 22 being kept up.

Figure 5:
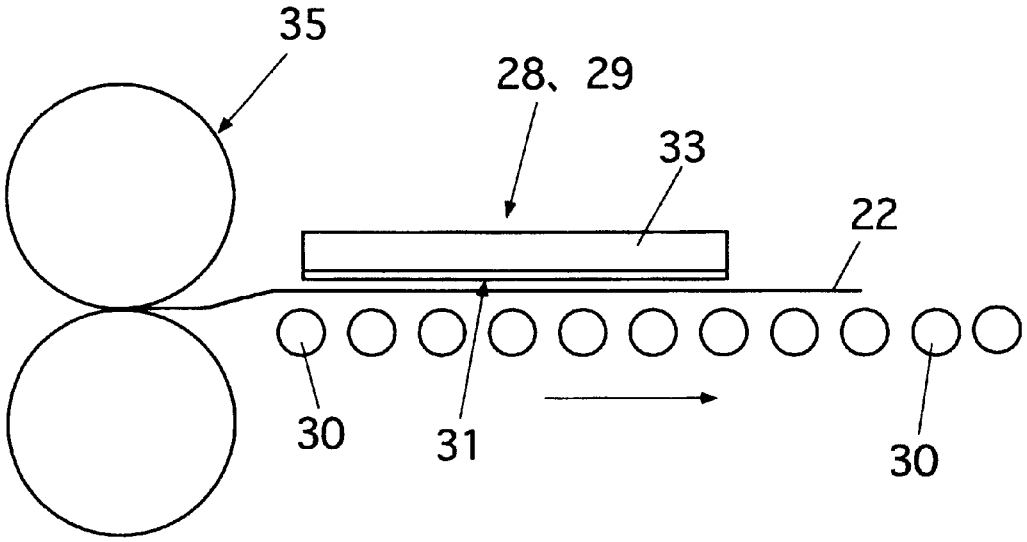
FIG. 5 is a diagram showing a second embodiment of a strip passing device.
Figure 6:
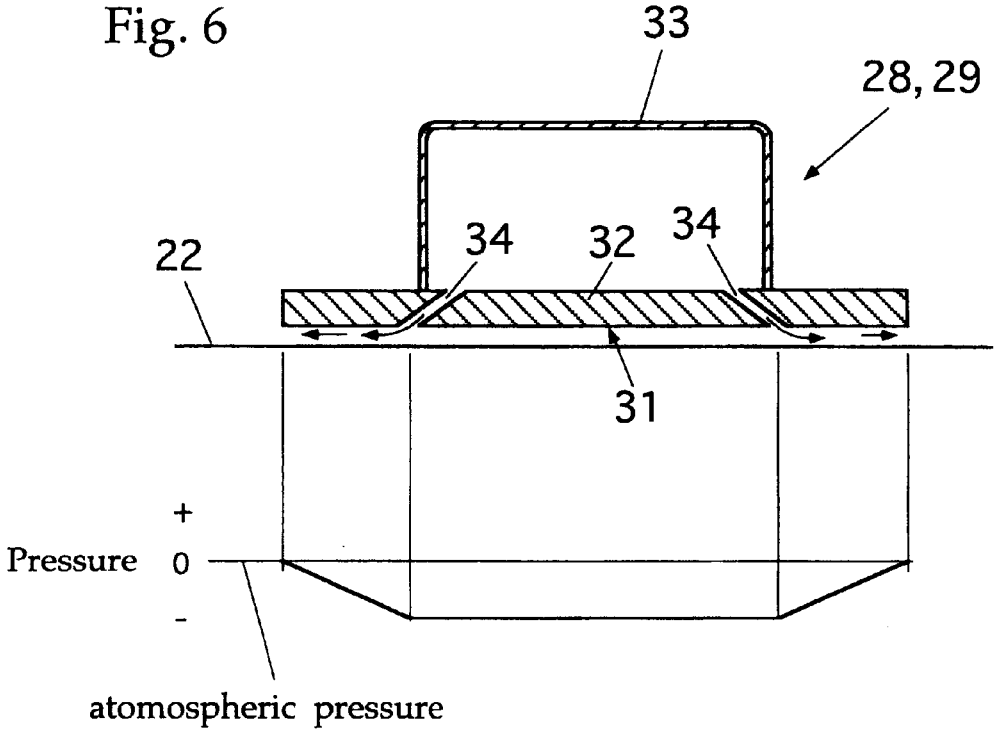
FIG. 6 is a breadthwise sectional view of FIG. 5.

FIG. 5 shows a second embodiment of the strip passing device; and FIG. 6 is a breadthwise sectional view thereof. As shown in FIG. 5, the strip passing devices 28 and 29 are installed above the top surface of the strip 22 so that they face against the table rollers 30. As shown in FIG. 6, the strip passing devices 28 and 29 are respectively provided with a pair of nozzles 34 which are shaped like slits in a bottom surface 32 and which extend widthwise and outward from the interior of an air header 33; high-speed air jet is emitted through the nozzles. The air between the surface of the guide 31 and the strip 22 is caught by the high-speed airflows emitted in the opposite directions from each other and emitted, causing the pressure in that area to become lower than the atmospheric pressure. Accordingly, the strip 22 rises toward the strip passing device due to the suction force shown in the pressure diagram at the lower part of FIG. 6 according to the pressure difference between the atmospheric pressure acting onto the bottom surface of the strip 22 and the top surface thereof facing the strip passing device. Positively holding the thin strip 22 under suction makes the strip 22 nearly flat along the surface of the guide 31; therefore, the rigidity thereof in the direction of rolling line, enabling the carrying force of a pinch roll 35 and the like on the upstream to be adequately transmitted to the strip 22. This makes it possible to successfully run the thin strip at high speed.

Figure 7:
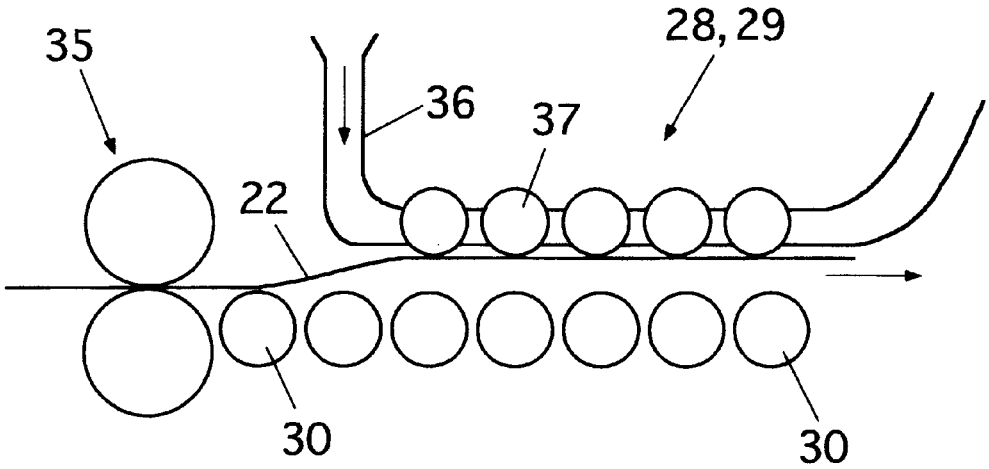
FIG. 7 is a diagram showing a third embodiment of a strip passing device.
Figure 8:
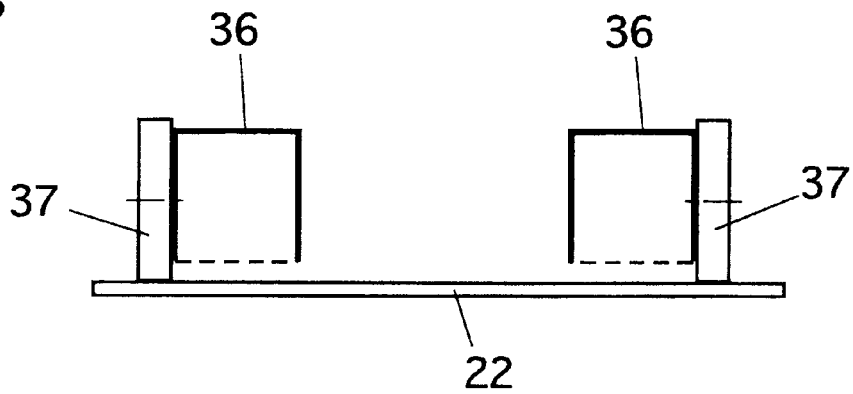
FIG. 8 is a breadthwise sectional view of FIG. 7.

FIG. 7 shows a third embodiment of the strip passing device; and FIG. 8 is a breadthwise sectional view of FIG. 7. In FIG. 7, a duct 36 is provided above the top surface of the strip 22 in the direction in which the strip 22 advances, so that it is opposed to table rollers 30. As shown in FIG. 8, a plurality of the ducts 36 are provided widthwise (in two trains in this embodiment); the bottom surfaces thereof facing the strip 22 are open. When air is let flow through the ducts 36 at high speed, the pressure on the top surface of the strip 22 where high-speed airflow is running drops lower than the atmospheric pressure on the bottom surface thereof due to the Bernoulli effect. Therefore, the strip 22 rise by being drawn up to the ducts 36 because of the difference in the pressure on the top and bottom surfaces of the strip. The strip 22 that has been drawn up is pressed against wheels 37 attached to the ducts 36 and fed out by the pinch roll 35 located on the upstream side. Thus, as previously described, the rigidity of the thin strip 22 in the rolling line direction is enhanced by positively holding it under suction so as to enable the carrying force of the upstream pinch roll 35 to be transmitted to the strip 22.

Figure 9:
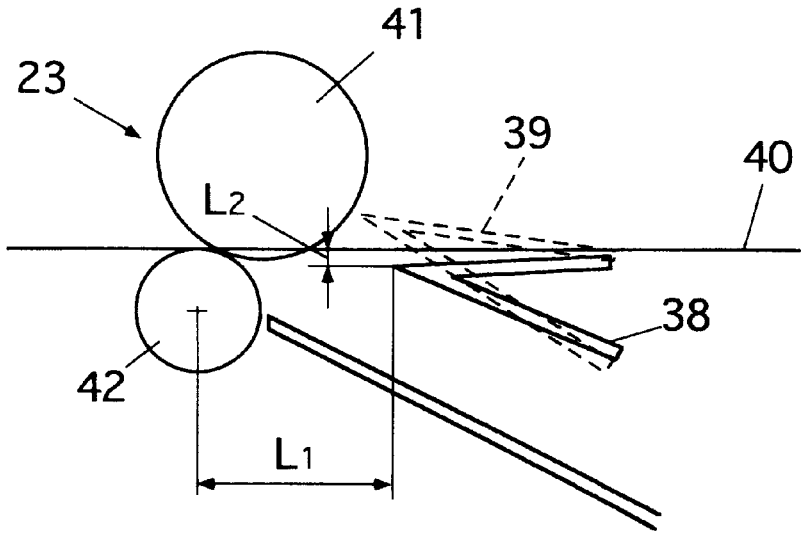
FIG. 9 is an example of the disposition of an exit side gate.

FIG. 9 shows the layout of a gate 38 on the exit side of the pinch roll 23 in the endless rolling wherein the strip is divided into coils. The position of the gate 38 on the exit side of the endless rolling is indicated by the solid line in the drawing; the distal end of the gate is lower than a pass line 40 by L2, which is different with the position of the gate 39 in batch rolling indicated by the dashed line. Hence, there has been a danger in that, if the leading end of the strip 22 should be caught in a double layer in the gap between upper and lower pinch rolls 41 and 42, then it may cause the upper pinch roll 41 to jump up in the pinch rolls 23 and 25 in which the conventional upper pinch roll 41 is held by an air cylinder, preventing the strip 22 from being led to the down coilers 24 and 26 with a consequent interruption of rolling. In the batch rolling, even if the upper pinch roll 41 jumps up, causing the strip 22 to slip off, the strip 22 bumps the guide 39 on the exit side and it is guided to the down coiler 24 because the distal end of the guide 39 on the exit side is located above the pass line 40 as illustrated in FIG. 9.

Figure 10:
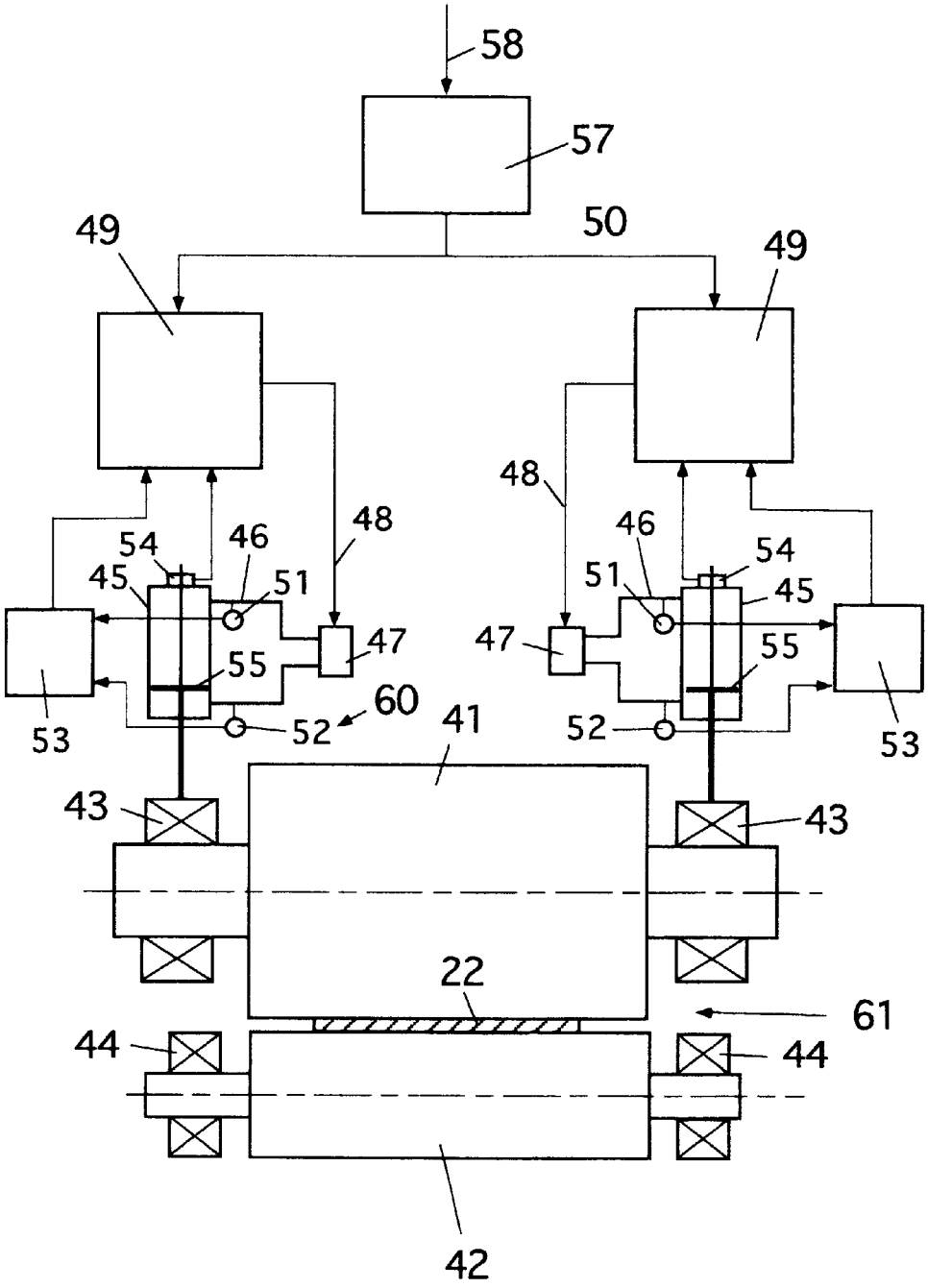
FIG. 10 is a diagram illustrating an embodiment of a hydraulic pinch roll.

FIG. 10 shows an embodiment of a hydraulic pinch roll adapted to solve the inconvenience described above. In the hydraulic pinch roll according to this embodiment, the upper pinch roll 41 is supported by hydraulic cylinders 45. In this drawing, the upper pinch roll 41 and the lower pinch roll 42 are rotatably mounted on upper chocks 43 (bearings) and lower chocks 44 (bearings) provided in a housing (not shown). The strip 22 is clamped between the upper and lower pinch rolls 41 and 42 so that its advancing direction is changed downward at an angle and it is led by the down coilers 24 and 26 to be taken up.

The hydraulic cylinders 45 are disposed on the right and left bearings of the upper pinch roll 41 and connected to servo valves 47 via pipes 46. The lift of the servo valves 47 is controlled by a command signal 48 to regulate the amount of incoming and outgoing hydraulic oil into the cylinders 45. The command signal 48 is generated by a controller 49, namely, a pinch roll controller; it controls the servo valves 47 so that the position and pressing force of the upper pinch roll 41 coincide with set values. The pinch roll controller 49 receives a setting signal 50 from a setter 57 to produce the command signal for the servo valves 47; it receives a sequence signal 58 from a higher-order controller or a processing computer, not shown, as the strip 22 moves forward so as to adjust the gap of the pinch roll or change the pressing force.

In the embodiment shown in FIG. 10, a pressing force detector 60 is composed of pressure detectors 51 and 52 for detecting the pressures on the head side and the rod side of the hydraulic cylinders 45; it calculates pressing force F of a hydraulic pinch roll 61 from the signals received from the pressure detectors 51 and 52 by using a computing device 53. A position detector 54 detects the positions of pistons 55 of the hydraulic cylinders 45. In place of the pressure detectors 51 and 52 shown in FIG. 10, load cells for directly detecting the pressing force of the pinch roll 61 may be provided on the bearings 44 of the lower pinch roll 42.

Figure 11:
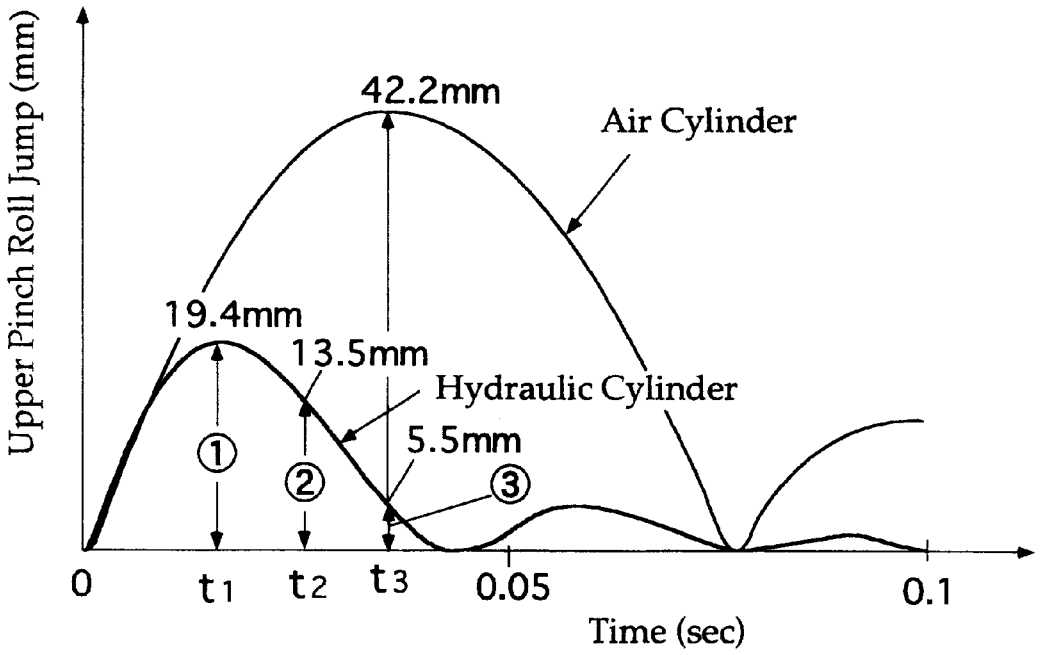
FIG. 11 is a comparative chart showing the jump of an air pinch roll and that of the hydraulic pinch roll.

FIG. 11 shows the comparison of the jumping amount of the upper pinch roll 41 in the conventional air pinch roll adapted to hold the upper pinch roll 41 by air cylinders and the jumping amount of the upper pinch roll 41 in the hydraulic pinch roll 61 adapted to hold the upper pinch roll 41 by the hydraulic cylinders 45 in accordance with the present invention. In this embodiment, the results of a simulation based on an assumption that the leading end of the strip 22 which is 2.6 mm thick is caught between the upper and lower pinch rolls 41 and 42 in a double layer.

As it is seen in the chart, in the case of the air cylinders, even when a preload of 100 tons is applied, the upper pinch roll 41 jumps 42.2 mm at maximum, which is 16 times the thickness and it takes a long time to come back to the position to hold the strip 22. In contrast to this, in the case of the hydraulic cylinders, the upper pinch roll 41 jumps only 19.4 mm at maximum and quickly comes back to the position to hold the strip 22.

Figure 12A:
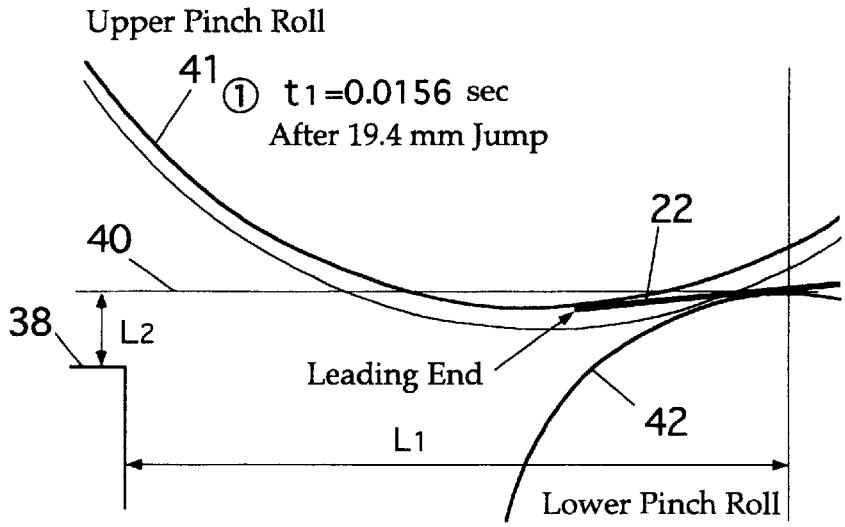
FIGS. 12A, 12B, and 12C show the passing trajectories of the leading end of a strip in the hydraulic pinch roll.
Figure 12B:
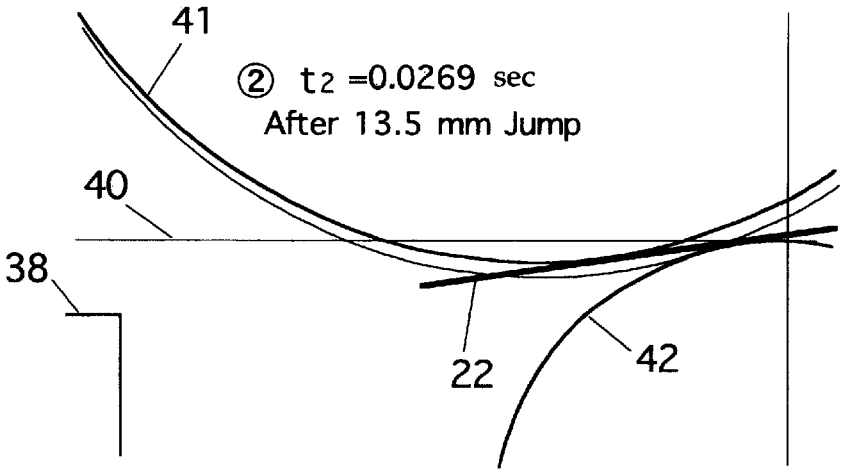
Figure 12C:
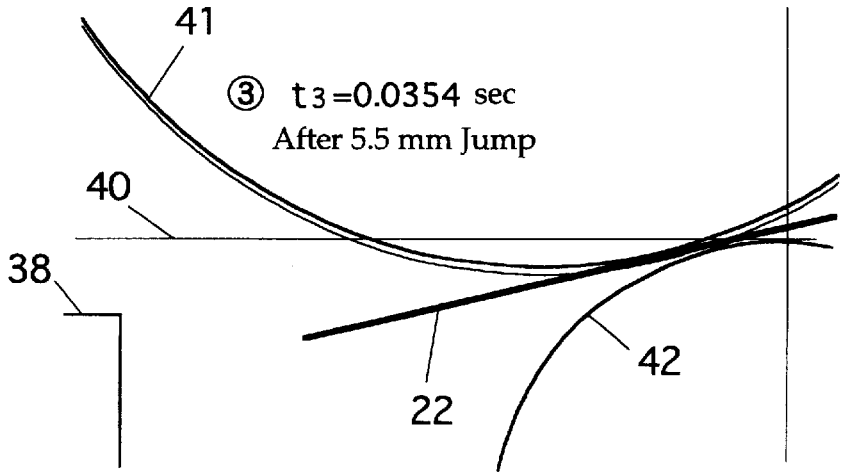

FIGS. 12A, 12B, and 12C show the trajectories of the leading end of the strip 22 versus the movement of the upper pinch roll 41. The distal end of the gate 38 on the exit side is located L1 away from the center of the pinch roll 42 and lower than the pass line 40 by L2 at maximum. Hence, the moment the leading end of the strip 22 goes down L2 or more by being pressed by the upper pinch roll 41 while it advances a distance of L1, the strip 22 is guided toward the down coiler 24 and it does not miss the gate 38.

The jumps of the upper pinch roll 41 at points t1, t2, and t3 of FIG. 11 are 19.4 mm, 13.5 mm, and 5.5 mm, respectively: the trajectories of the leading end of the strip 22 passing through the roll gap formed by the positional relationship of the upper and lower pinch rolls 41 and 42 at the foregoing points are shown in FIG. 12. Since the jumped upper pinch roll 41 of the hydraulic pinch roll 61 comes back quickly, the leading end of the strip 22 already reaches L2 or lower than the pass line 40 at point t3 of ③ of FIG. 12C; therefore, the leading end of the strip 22 does not run over or miss the gate 38 on the exit side. Thus, in the hydraulic pinch roll 61 in accordance with the present invention, the hydraulic rigid spring makes the upper pinch roll 41 quickly come back even when it jumps, providing a great advantage in that the stable guidance of the leading end of the strip 22 can be achieved in comparison with the air cylinder type. This advantage has been confirmed with an actual machine.

The constitution described above makes it possible to cut a spliced strip which has been rolled to a predetermined thickness into a plurality of strips at the exit side of the finish rolling mill by the shearing machine installed at the exit side of the finish rolling mill and to feed them to the hydraulic pinch rolls in a stable manner by using the strip passing devices, then further led to the down coilers in a stable manner by the hydraulic pinch rolls. As a result, a thin strip having a thickness of about 1 mm can be turned into coils of strips, which was impossible in the past.

Thus, the take-up equipment in accordance with the present invention is provided with the shearing machine at the exit side of the finish rolling mill, so that it is capable of cutting a plurality of joined strips, which have been rolled to a predetermined thickness, into separate strips at the exit side of the finish rolling mill. Moreover, the strip passing devices are provided between the shearing machine and the pinch roll and between the pinch roll and the pinch roll of the following down coiler so as to ensure stable feed of even a strip as thin as approximately 1 mm to the pinch rolls by preventing the leading end of the strip from rising. In addition, the use of the hydraulic pinch rolls enables stable guide of the strip to the down coiler, making it possible to produce a coil of thin strip having a thickness of about 1 mm, which has been impossible in the conventional hot rolling process.

Figure 13:
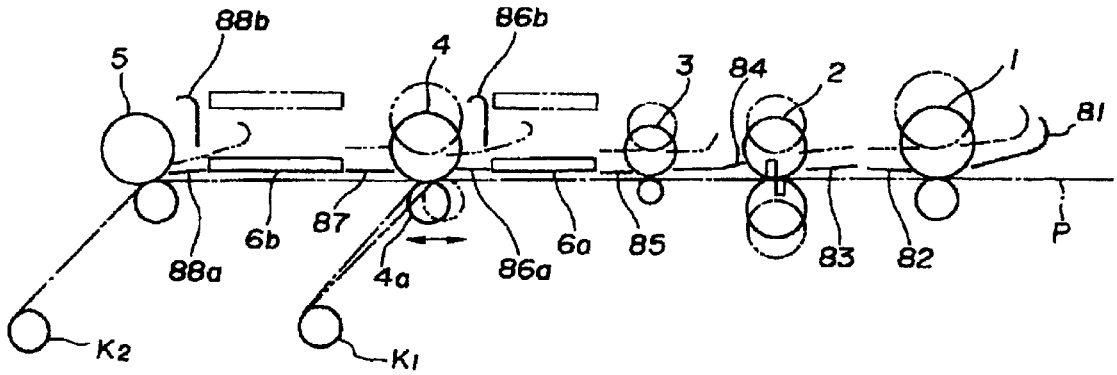
FIG. 13 is a general block diagram showing a second embodiment of the take-up equipment in accordance with the present invention.

FIG. 13 is a general block diagram showing a second embodiment of the take-up equipment in accordance with the present invention.

FIG. 13 shows the downstream side of a finish rolling mill which continuously performs finish rolling a joined sheet bar in a continuous hot rolling line: a pinch roll 1 on the entrance side of the shearing machine, a rotary shearing machine 2, a pinch roll 3 on the exit side of the shearing machine, a pinch roll 4 for No. 1 coiler $K_1$, and a pinch roll 5 for No. 2 coiler $K_2$ are disposed from the upstream side along pass line P. The No. 1 coiler $K_1$ and the No. 2 coiler $K_2$ are disposed in series along the line from the upstream side.

A lower roll 4*a* of the pinch roll 4 is configured so that it can be moved in parallel to the pass line by a hydraulic cylinder or the like. By the hydraulic cylinder 45 shown in FIG. 10, the upper pinch roll is pulled upward and the lower roll 4*a* is moved in parallel to the pass line. When the lower roll 4*a* is shifted toward the upstream, the advancing direction of the strip is shifted toward the No. 1 coiler $K_1$. Hence, the moving mechanism for the lower roll 4*a* corresponds to the changing means in the present invention.

Figure 14:
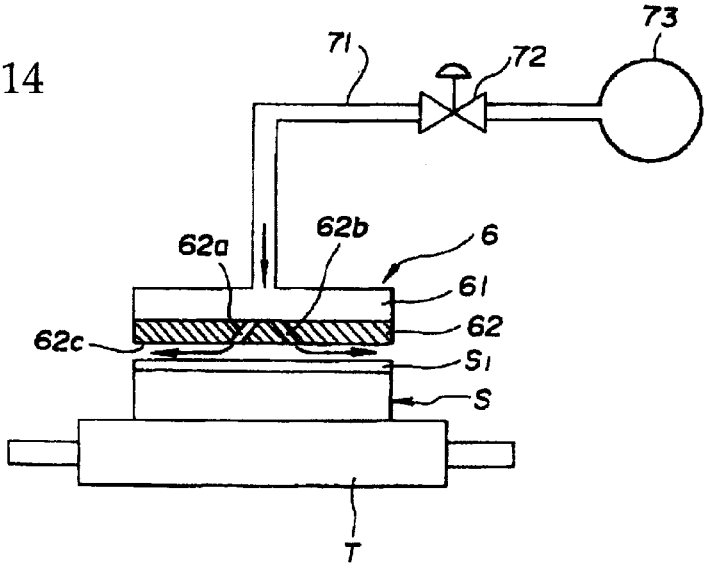
FIG. 14 is a sectional view in the direction of the plate width illustrating the strip passing device employed in the embodiment in accordance with the present invention.

Disposed at the entrance side of the pinch rolls 4 and 5 are strip passing devices 6 (6*a*, 6*b*) as shown in FIG. 14. The respective strip passing devices 6*a* and 6*b* are placed at 10 to 50 mm above pass line P as indicated by the solid lines in FIG. 13 when they are in use, while they are placed away from pass line P as indicated by the two-dot chain line in FIG. 13 when they are not in use. FIG. 14 shows basically the same constitution as that shown in FIG. 6 except that it illustrates the constitution based more on an actual machine; it is a breadthwise sectional view of the strip passing device 6 in operation, reference character T denoting a table roller T guiding the bottom surface of strip S.

The strip passing device 6 is composed of a chamber 61 having a predetermined capacity and a guiding member 62 covering the entire surface of the chamber 61. A gas supply channel 71 is connected to the top of the chamber 61; the gas supply channel 71 is connected to a gas supply source 73 via a flow rate regulating valve 72. The guiding member 62 has a plurality of nozzle bores 62*a* and 62*b* formed vertically at angles along pass line P at predetermined intervals. The nozzle bores 62*a* and 62*b* are shaped so that they spread downward from the center of the width of the guiding member 62 toward both ends of the width. The bottom surface of the guiding member 62 is formed into a plane which provides a guiding surface 62*c* opposed to the top surface of strip S.

Hence, when a high-pressure gas adjusted to a predetermined flow rate by the flow rate regulating valve 72 is introduced into the chamber 61 via the gas supply channel 71, the gas in the chamber 61 is jetted through the nozzle bores 62*a* and 62*b* to become high-speed gas streams running along the guiding surface 62*c*. When strip S is present right below the strip passing device 6 under these conditions, the air between the guiding surface of the strip passing device and the strip is involved in the high-speed air streams emitted in the opposite directions from each other and discharged as previously mentioned, and the pressure at the upper side becomes lower than the pressure of the stationary open air at the bottom surface of strip S, causing strip S to be drawn to the guiding surface 62*c* under suction due to the difference between the two pressures. If the gap between strip S and the guiding surface 62*c* becomes smaller than a certain dimension, then the air resistance to the high-speed gas streams increases and the suction force weakens. As a result, strip S is held up in a position where the suction force and the weight of strip S are balanced. The drawing shows a state wherein leading end S1 of strip S has been introduced right below the strip passing device 6 and held up. Disposed above pass line P are: a strip passing guide 81 immediately before the entrance side of the pinch roll 1; a strip passing guide 82 immediately after the exit side of the pinch roll 1; a strip passing guide 83 immediately before the entrance side of the shearing machine 2; a strip passing guide 84 between the shearing machine 2 and the pinch roll 3; a strip passing guide 85 between the pinch roll 3 and the strip passing device 6*a;* strip passing guides 86*a* and 86*b* between the strip passing device 6*a* and the pinch roll 4; a strip passing guide 87 between the pinch roll 4 and the strip passing device 6*b;* and strip passing guides 88*a* and 88*b* between the strip passing device 6*b* and the pinch roll 5.

The heights at which the strip passing guides are positioned above pass line P until the leading end (the first leading end that is not the edge cut by the shearing machine 2) of a continuously hot-rolled strip out from the finish rolling mill is first wound onto a coiler, namely, the No. 1 coiler $K_1$ in this embodiment, are different from the heights at which they are positioned after that; the positions thereof in these two cases are shown by solid lines and two-dot chain lines in FIG. 13.

Figure 15A:
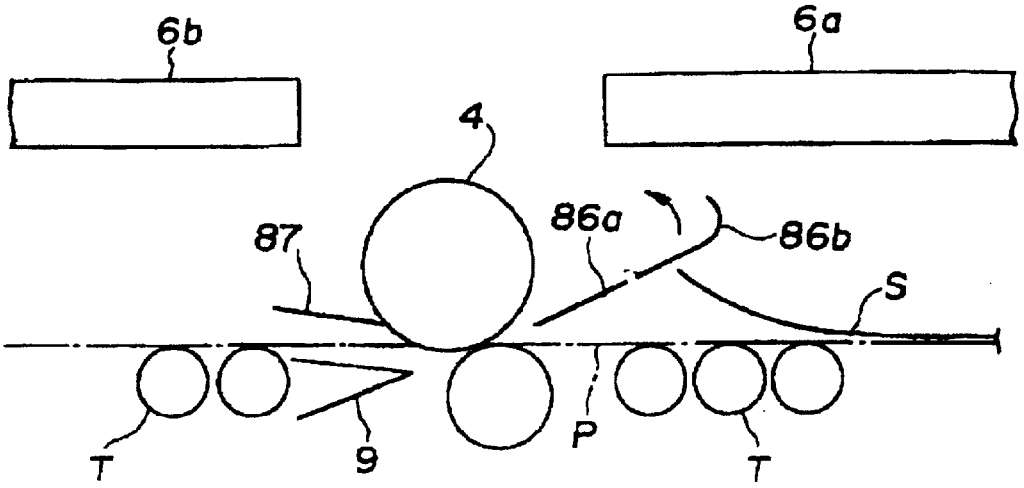
Figure 15B:
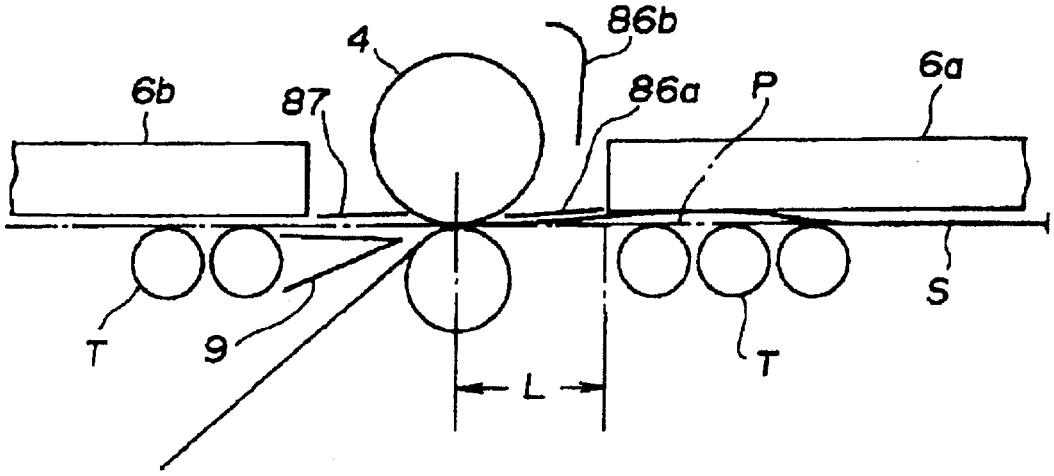

The strip passing guides located between the strip passing device 6 (6*a*, 6*b*) and the pinch rolls 4, 5 are constituted by the pinch roll introducing guide 86*a* (88*a*) provided near the pinch rolls and a separate top guide 86*b* (88*b*). As shown in FIG. 15, the top guide 86*b* (88*b*) is positioned between the strip passing device 6 and pass line P when the strip passing device 6 has been retracted from pass line P (see FIG. 15A), and strip S is guided to the pinch roll introducing guide 86*a* (88*a*); while it is positioned between the strip passing device 6 and the pinch roll 4 (5) when the strip passing device 6 has been set in the vicinity of pass line P to be ready for operation (see FIG. 15B).

In other words, as seen from FIG. 15, the top guide 86*b* turns around a predetermined center of rotation to switch from the state illustrated in FIG. 15A to that illustrated in FIG. 15B. This feature of the top guide 86*b* allows distance L between the center of the pinch roll 4 and the strip passing device 6*a* can be reduced when the strip passing device is in operation as shown in FIG. 15B. Thus, bringing the strip passing device very closely to the entrance side of the pinch roll ensures smooth introduction of strip S from the strip passing device to the pinch roll.

Reference numeral 9 of FIG. 15 denotes a member that prevents strip S from interfering with downstream table rollers T when it moves from the pinch roll 4 to No. 1 coiler $K_1$.

The method for taking up the continuously hot-rolled strip by the equipment will now be described.

Figure 16A:
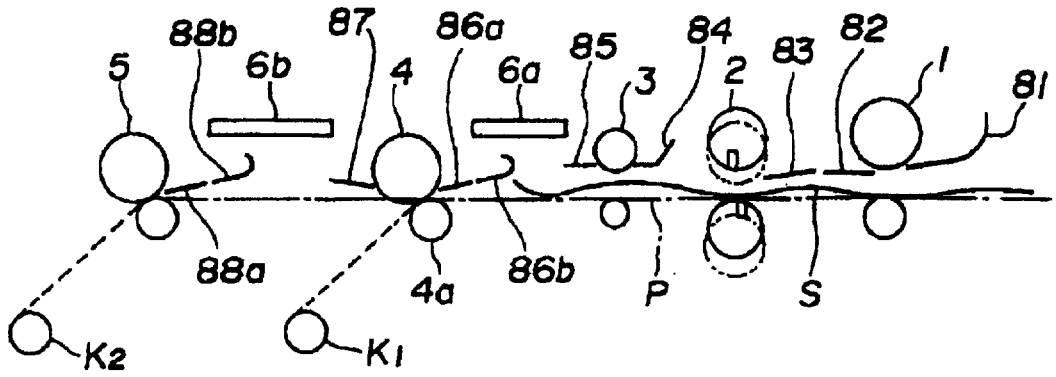
FIG. 16A is a schematic block diagram showing the layout of the respective constituent units above the pass line until the first leading end of a strip reaches No. 1 coiler when taking up a first coil by No. 1 coiler $K_1$.
Figure 16B:
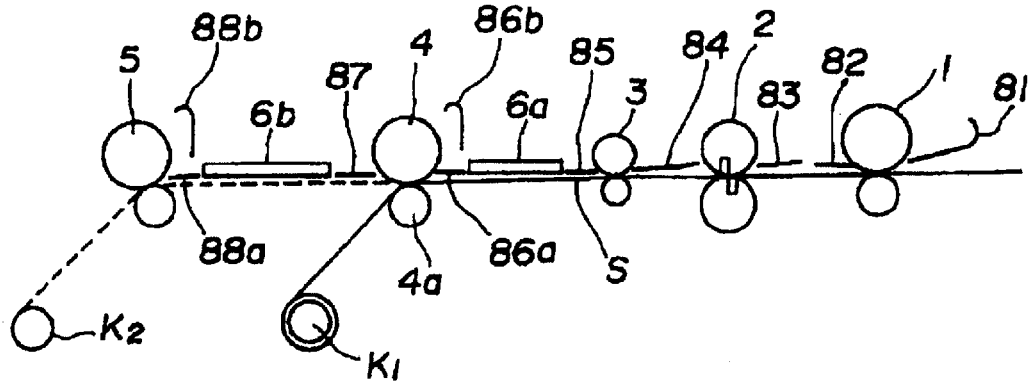
FIG. 16B shows the same when the first cutting is performed by a shearing machine.

FIG. 16A shows the layout of the respective constituent units above pass line P until the first leading end of a strip reaches No. 1 coiler $K_1$ when taking up a first coil by No. 1 coiler $K_1$, and FIG. 16B shows the same when the first cutting is performed by the shearing machine 2.

As illustrated in FIG. 16A, until the first leading end is wound onto No. 1 coiler $K_1$, the lower roll 4*a* of the pinch roll 4 is shifted toward the upstream so that the pinch roll 4 causes strip S to advance toward No. 1 coiler $K_1$. The strip passing guide 87 opens at an angle so that the downstream end thereof is higher. The strip passing devices 6*a* and 6*b* are retracted considerably away above pass line P in advance. The pinch roll introducing guides 86*a* and 88*a* open at angles so that the upstream ends thereof are higher; the top guides 86*b* and 88*b* are disposed between the strip passing devices 6*a* and 6*b* and pass line P so that the curled portions at the distal ends thereof are up at the angles continuing from the foregoing angles.

The upper rolls of the pinch rolls 1 and 3 and the upper drum of the shearing machine 2 are raised sufficiently high to avoid contact with strip S, and all strip passing guides 81 through 85 are also raised to the bottom edges of the upper rolls. The strip passing guide 81 has the upstream-side distal end shaped to curl outward so as to enable the leading end of strip S, which has left the finish rolling mill, to be smoothly introduced between the upper roll and the lower roll of the pinch roll 1.

Hence, if the operation of the entire continuous hot rolling equipment is begun under the conditions described above, the upper side flexure of the leading end of strip S leaving the finish rolling mill is restricted by the strip passing guides 81 through 85 although it vertically flexes, and the leading end is introduced to the pinch roll 4 while being guided by the top guide 86*b* and the pinch roll introducing guide 86*a* and wound on No. 1 coiler $K_1$.

When the leading end has been wound on No. 1 coiler $K_1$, the entire shearing machine 2 is moved down to stand by for cutting as indicated by the two-dot chain line in FIG. 16A; the remaining constituent units are moved as illustrated in FIG. 16B to wind the strip at high speed on No. 1 coiler $K_1$.

More specifically, the top guides 86*b* and 88*b* are turned to be placed between the strip passing devices 6*a,* 6*b* and the pinch rolls 4, 5. The strip passing devices 6*a* and 6*b* are positioned at 10 to 50 mm above pass line P; however, no gas is introduced into the chambers. The strip passing guide 87, the pinch roll introducing guides 86*a,* 88*a,* and the strip passing guides 81 through 85 are positioned substantially parallel to pass line P at 10 to 50 mm above pass line P. The strip passing guide 84 is shaped so that the exit side relative to the shearing machine 2 opens at an angle; this angle is set smaller than that shown in FIG. 16A. The lower roll 4*a* of the pinch roll 4 is moved to a position where the center thereof matches that of the upper roll or toward the downstream side therefrom. The upper rolls of the pinch rolls 1 and 3 are moved down to predetermined positions.

By positioning the constituent units as described above, strip S can be carried from the pinch roll 1 to the pinch roll 4 while the gap relative to pass line P being restricted to 10 to 50 mm by the strip passing guides 81 through 85, the guiding surface 62*c* of the strip passing device 6*a,* and the pinch roll introducing guide 86*a,* thus enabling strip S to be passed at high speed in a stable fashion. Before the first cutting point reaches the pinch roll 1, the upper and lower drums are brought close to pass line P so as to set the shearing machine 2 ready for cutting according to a cutting timing as illustrated in FIG. 16B, and the introduction of gas into the chambers of the strip passing devices 6*a* and 6*b* is begun.

When cutting the strip by the shearing machine 2 under the aforesaid condition, the trailing end of a cut preceding strip, i.e. the first strip, is wound on No. 1 coiler $K_1$, while the leading end of the following strip, i.e. the second strip, goes straight along pass line P without being shifted by the pinch roll 4 and introduced smoothly from the strip passing guide 87 to the strip passing device 6*b* and further from the pinch roll introducing guide 88*a* to the pinch roll 5 to be wound on the coiler $K_2$.

At this time, the trailing end of the preceding strip is supported under suction by the strip passing device 6*a,* causing the apparent rigidity of strip S to be increased; therefore, the strip can be wound on No. 1 coiler $K_1$ in a stable manner. Likewise, since the leading end of the following strip is supported under suction by the strip passing devices 6*a* and 6*b,* causing the apparent rigidity of strip S to be increased; therefore, the strip can be passed at high speed and wound on the coiler $K_2$ in a stable manner.

Further, since the pinch roll 1 holds strip S on the following strip side at the time of cutting by the shearing machine 2, the following strip is prevented from springing back toward the finish rolling mill after cutting. The pinch roll 3 smoothes out the wavy leading end of the following strip to allow smooth introduction to the pinch roll 4. The space above pass line P is limited to 10 to 50 mm by the strip passing guides 82 through 85 and 87, and the pinch roll introducing guides 86*a* and 88*a,* minimizing the chance of puckering caused by the wavy motion of strip S when it runs at high speed. The installation of the strip passing guides 85 and 87 enables strip S, which has the propelling force imparted by the pinch rolls 3 and 4, to be smoothly introduced to the strip passing devices 6*a* and 6*b*.

Thus, according to the arrangement described above, strip S finish-rolled to be thin by continuous hot rolling can be taken up while passing it at high speed in a stable manner.

Figure 17A:
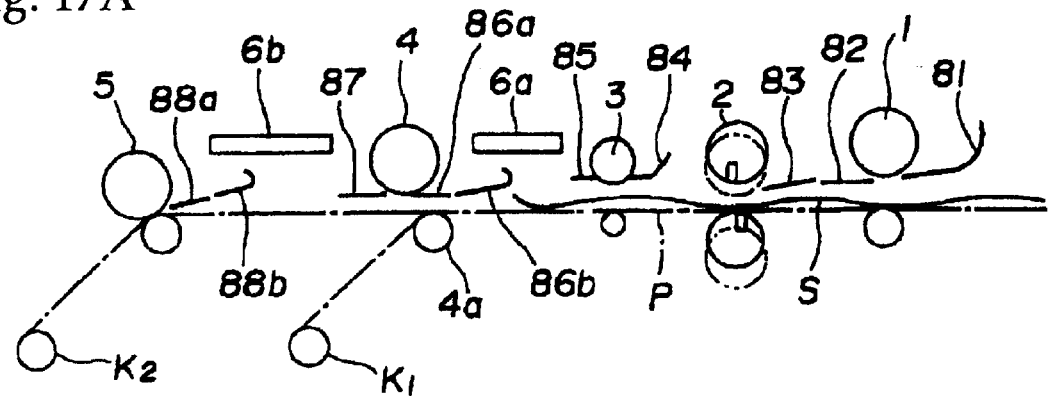
FIG. 17A is a schematic block diagram showing the layout of the respective constituent units above the pass line until the first leading end of a strip reaches No. 2 coiler when taking up the first coil by No. 2 coiler $K_2$ located at the lowermost downstream.
Figure 17B:
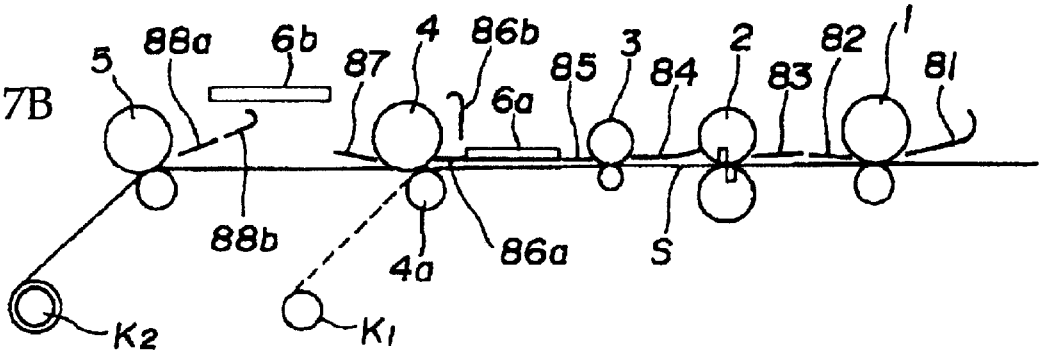
FIG. 17B shows the same when the first cutting is performed by a shearing machine.
Figure 17C:
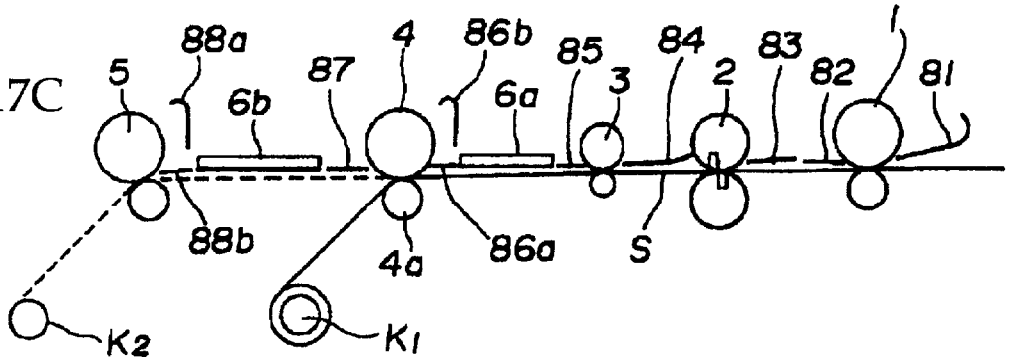
FIG. 17C shows the same when the following cutting is performed.

FIG. 17A shows the layout of the constituent units above pass line P until the first leading end of a continuously hot-rolled strip reaches No. 2 coiler $K_2$; FIG. 17B shows the same when the first cutting is carried out by the shearing machine 2; and FIG. 17C shows the same when the second cutting is carried out, when a first strip to be coiled is wound on No. 2 coiler $K_2$ located at the lowermost downstream.

The layout shown in FIG. 17A is substantially the same as that shown in FIG. 16A except that the upper roll of the pinch roll 4 is positioned away from the lower roll 4*a*. Hence, when the operation of the entire continuous hot rolling equipment is started under this condition, the leading end of strip S leaving the finish rolling mill is restricted in its vertical flexture by the strip passing guides 81 through 85 and 87 and the pinch roll introducing guide 86*a* although it vertically flexes, and the leading end is introduced to the pinch roll 5 while being guided by the top guide 88*b* and the pinch roll introducing guide 88*a* and wound on the coiler $K_2$. When the leading end has been wound on the coiler $K_2$, the entire shearing machine 2 is moved down to stand by for cutting as indicated by the two-dot chain line in FIG. 17A; the remaining constituent units are moved as illustrated in FIG. 17B to wind the strip at high speed on No. 2 coiler $K_2$. More specifically, the layout of the constituent units is changed in the same manner as FIG. 16A and FIG. 16B except that the positions of the strip passing device 6*b,* the pinch roll introducing guide 88*a,* the top guide 88*b,* and the lower roll 4*a* of the pinch roll remain unchanged; thus, strip S is passed at high speed and wound on No. 2 coiler $K_2$ in a stable fashion.

Then, at a proper timing, the shearing machine 2 is set ready for cutting and the gas is introduced into the chamber of the strip passing device 6*a* and cutting is implemented by the shearing machine 2. This makes the trailing end of the cut preceding strip, i.e. the first strip, to be wound on No. 2 coiler $K_2$ and the leading end of the following strip, i.e. the second strip, is introduced from the pinch roll introducing guide 86*a* to the pinch roll 4 and bent by the pinch roll 4 to be wound on No. 1 coiler $K_1$. At this time, the leading end of the following strip is supported under suction by the strip passing device 6*a,* causing the apparent rigidity of the following strip to be increased; therefore, the leading end of the following strip can be passed at high speed and wound on No. 1 coiler $K_1$ in a stable manner. Setting the strip passing device 6*b* ready for operation at the foregoing timing enables the trailing end of the preceding strip to be supported under suction by the strip passing device 6*b* immediately before the pinch roll 5, thus permitting stable winding on No. 2 coiler $K_2$.

Then, the shearing machine 2 is set in the standby mode for cutting, the strip passing device 6*b* is moved down to the operating position, and the two strip passing devices 6*a* and 6*b* are stopped in the positions to perform high-speed winding on No. 1 coiler $K_1$ as in the case illustrated in FIGS. 16A and 16B. After that, at the next timing, the shearing machine 2 is set ready for cutting and a gas is introduced into the chambers of the strip passing devices 6*a* and 6*b* to set them ready for operation as illustrated in FIG. 17C. This makes it possible to perform stable winding of the trailing end of the preceding strip, i.e. the second strip, on No. 1 coiler $K_1$ after cutting by the shearing machine 2 and the leading end of the following strip, i.e. the third strip, on No. 2 coiler $K_2$ as in the case shown in FIGS. 16A and 16B.

To take up the trailing end of strip S which has been subjected to the continuous hot rolling and which has just left the finish rolling mill, namely, the trailing end of the last strip rather than a edge cut by the shearing machine 2, the constituent units should be set as illustrated in FIG. 16A or FIG. 17A when the trailing end has left the finish rolling mill to prevent the trailing end from being broken, causing such a problem of clogging up the constituent units. In the embodiment, two coilers $K_1$ and $K_2$ are disposed in series along the line; this embodiment can be applied to a case where three or more coilers are disposed. The strip passing guides 81 through 85 and 87, the pinch roll introducing guides 86*a,* 88*a,* and the top guides 86*b,* 88*b* are not indispensable; however, providing those guides enables further stable high-speed passing and winding. The pinch roll introducing guide 86*a* (88*a*) and the top guide 86*b* (88*b*) may alternatively be made integral.

In the embodiment, the top guides 86*b* and 88*b* are configured so that they turn to withdraw to the position above pass line P and between the strip passing devices 6*a,* 6*b* and the pinch rolls 4, 5, respectively. The withdrawing position, however, is not limited thereto; they may alternatively withdraw to a position off pass line P, for example, sideways relative to pass line P.

Further in the embodiment, the advancing direction of strip S is changed by moving only the lower roll 4*a* of the pinch roll 4; the changing means in the invention, however, is not limited thereto: both upper and lower rolls may alternatively be tilted together.

Thus, according to the take-up equipment and the take-up method for hot-rolled material in accordance with the present invention described above, thin strips can be taken up in a stable manner by passing them at high speed. This makes it possible to achieve high-speed feed at a higher yield, to secure the temperature of strips at the exit side of a finish rolling mill with resultant higher quality, and hence to secure a predetermined sales.

Figure 18:
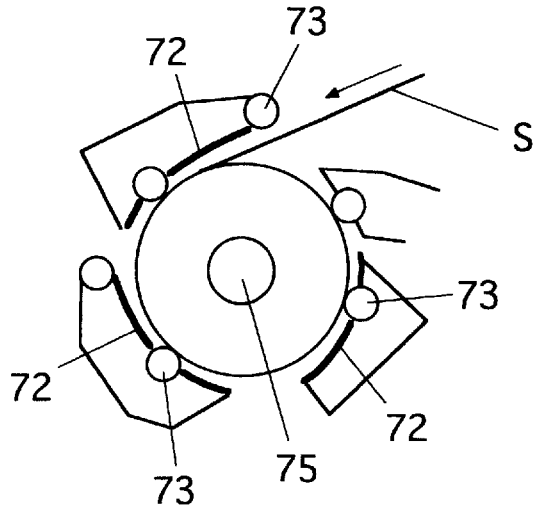
FIG. 18 is a partial diagram showing a take-up machine in accordance with the present invention.

FIG. 18 is a partial diagram showing a take-up equipment in accordance with the present invention. The winding roll of the take-up equipment in the drawing has guides 72 that are located substantially along the outer periphery of the coil wound around a mandrel 75. When strip S has been wound around the mandrel 75 and the take-up has been completed, the guides press winding rolls 73 against the outer periphery of the coil to hold the trailing end of the strip S. Thus, upon completion of take-up, the trailing end of strip S is held to prevent buckling caused by the flopping of the trailing end, ensuring smooth take-up operation.

Figure 19:
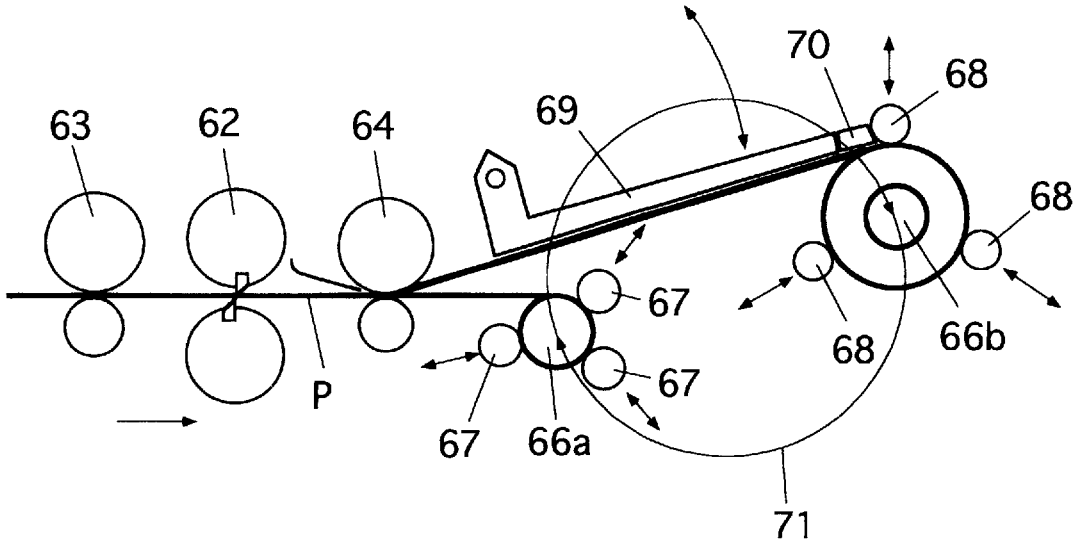
FIG. 19 is a general block diagram showing a third embodiment of the take-up equipment in accordance with the present invention.

FIG. 19 is a general block diagram showing a third embodiment of the take-up equipment in accordance with the present invention. In the drawing, the plurality of take-up machines have carousel type reels, each composed of two winding drums 66*a* and 66*b*. The two winding drums 66*a* and 66*b* revolve along the arc indicated by an arrow 71; one of them (the winding drum 66*a* in the drawing) is positioned at the lowermost downstream of pass line P of strip S on a hot rolling line, while the other (the winding drum 66*b* in the drawing) is located away from pass line P. Provided on the upstream side of the carousel type reel are a shearing machine 62 and pinch rolls 63 and 64 respectively located at the entrance side and the exit side thereof.

In the carousel type reel, the winding drum 66*a* located at the lowermost downstream of pass line P is provided with a wrapper roll 67 to allow strip S to be smoothly wound around the winding drum 66*a*. The other winding drum 66*b* located away from pass line P is provided with a snubber roll 68 for holding the trailing end of the strip so as to hold the trailing end of the wound strip to prevent it from unwinding.

Further as shown in FIG. 19, a guiding device for restricting the rising height of the strip or a swing type strip passing device 69 for drawing in the strip by an airflow is disposed between the winding drum 66*b* located away from pass line P and the pinch roll 64 so as to enable smooth passing of the strip from the pinch roll 64 to the winding drum 66*b*. When the two winding drums 66*a* and 66*b* revolve along the arc indicated by the arrow 71, the swing type strip passing device 69 swings away outward to avoid interfering with their trajectories.

In the vicinity of the other winding drum 66*b,* a strip trailing end guide 70 is provided between downstream side of the strip passing device 69 and the drum on the coil ejecting side, namely, the winding drum 66*b,* in order to introduce the strip, which has been guided by the swing type strip passing device 69, into the gap between the winding drum 66*b* and the snubber roll 68. The rest of the constitution is the same as the constitution of the first embodiment and/or the second embodiment.

According to the constitution of this embodiment, the winding of the strip is begun by winding it onto the winding drum 66*a,* which is located at the lowermost downstream end of pass line P, by using the wrapper roll 67, then the winding drum is swung to the position away from pass line P to wind the strip onto the winding drum (66*b* in this case) in that position. Upon completion of winding, the trailing end of the strip is held by the snubber roll 68 to prevent it from unwinding, and the strip is carried out or issued; at the same time, the winding of the next strip is begun by the winding drum 66*a* located at the lowermost downstream end, thus permitting high-speed winding of strips.

Although the invention has been described with reference to specific preferred embodiments, this description is not meant to be construed in a limiting sense. It is contemplated that the appended claims will cover any modifications, improvements and equivalents as fall within the true scope of the invention.

What is claimed is:

1. Take-up equipment for a hot-rolled material, comprising:

a plurality of take-up machines disposed at a downstream side of a hot finish rolling mill, wherein said take-up machines are disposed along a line having upstream and downstream directions, and each take up machine comprises a pinch roll at an upstream end;

a shearing machine provided on an upstream side of the pinch roll of the take-up machines at the upstream end; and an airflow suction strip passing device, provided between said shearing machine and the pinch roll at an upstreammost end of the take up machines, and disposed to draw a strip passing through the line by suction created by air flowing from the passing device.

2. Take-up equipment according to claim 1, further comprising a pinch roll provided at an upstream side end of said shearing machine.

3. Take-up equipment according to claim 1, wherein an airflow suction strip passing device is provided between the pinch rolls of said plurality of take-up machines.

4. Take-up equipment according to claim 1, wherein a downstream pinch roll is provided near a downstream side of said shearing machine and an airflow suction strip passing device is provided between said pinch roll and said shearing machine.

5. Take-up equipment according to claim 1, wherein said pinch rolls comprise upper and lower rolls and the upper rolls are movable are adapted so that they can be moved toward and away from the lower rolls by hydraulic cylinders.

6. Take-up equipment according to claim 1, wherein said strip passing device comprises guiding devices for restricting the rising height of a strip.

7. Take-up equipment according to claim 1, wherein said plurality of take-up machines comprise down coilers.

8. Take-up equipment according to claim 1, wherein said plurality of take-up machines have carousel type reels having two take-up drums.

9. Take-up equipment according to claim 2, wherein strip passing device is provided between said pinch roll on the upstream side of said shearing machine and said shearing machine.

10. Take-up equipment according to claim 7, wherein a pinch roll disposed on an upstream side of a down coiler other than a down coiler at a downstreammost end of the line.

11. Take-up equipment according to claim 7, wherein only strip passing devices disposed immediately before upstream sides of said respective take-up machines employ an airflow suction strip passing device.

12. Take-up equipment for continuous hot rolling according to claim 11, further comprising:

a second airflow suction strip passing device disposed upstream of a pinch roll of a second take-up machine;

a pinch roll disposed between the shearing machine and the pinch roll of the upstreammost take-up machine:

a pinch roll disposed upstream of the shearing machine; and a plurality of strip passing guides for guiding a strip along the line provided above the line, namely, first passing guides provided downstream of each airflow suction strip passing device and between each said pinch roll disposed upstream of the shearing machine and each airflow suction strip passing device, passing guides provided immediately upstream and downstream of the pinch roll disposed between the shearing machine and the pinch roll of the upstreammost take-up machine, and passing guides disposed immediately upstream and downstream of the pinch roll disposed upstream of the shearing machine.

13. Take-up equipment for continuous hot rolling according to claim 12, wherein said first strip passing guides further comprise pinch roll introducing guides and separate top guides; and wherein said airflow suction strip passing devices are retractable from said pass line, wherein, when said airflow suction strip passing devices are retracted, said top guides are placed in a position between said airflow suction strip passing devices and said line to guide a leading end of a strip to said pinch roll introducing guides; and wherein when said airflow suction strip passing devices are rested in the vicinity of said line where they are put in operation, said top guides are retracted to a position away from said line.

14. Take-up equipment according to claim 8, wherein said plurality of take up machines further comprises:

a first take-up drum located at at a downstream end of and below said line;

a wrapper roll provided for the first take-up drum, a second take-up drum located off said line a snubber roll, provided for the second take-up drum, which holds a trailing end of a strip;

a swing type strip passing device for drawing a strip by suction created by airflow flowing from the passing device, the passing device being disposed between said second take-up drum and said pinch roll at the upstream end of the take up machines [(64) positioned on said pass line P]; and a strip trailing end guide provided between a downstream end of said strip passing device and the second take-up drum.

15. A method for taking up a hot-rolled material comprising the steps of:

providing a line for hot rolling material having an upstream direction and a downstream direction;

a plurality of take-up machines at a downstream end of said line, each take-up machine comprising a pinch roll;

providing first strip passing device at an upstream side of each pinch roll, wherein said first strip passing device comprises a pinch roll introducing guide immediately upstream of the pinch roll and a separate top guides upstream of the pinch roll introducing guide;

placing downstream ends of said top guides higher above the line than said pinch roll introducing guides, winding an end of a strip of hot rolled material on one of the take-up machines, after said step of winding, moving the trailing ends of the top guides down to substantially the same level above the line as the pinch roll introducing guides.

16. A take-up method according to claim 15, further comprising the steps of:

providing a winding roll for each said take-up machines having a mandrel;

winding a roll of hot-rolled material around said mandrel;

providing a guide that substantially runs along an outer periphery of the coil wound around the mandrel, pressing said guide against the outer periphery of said coil in order to hold a trailing end of said strip when the strip has been wound up around said mandrel.

17. A take-up method according to claim 15, further comprising the steps of:

providing a plurality of airflow suction strip passing devices disposable to draw a strip passing through the line by suction created by air flowing from the passing device;

holding said airflow suction strip passing devices away form said line;

leading a first leading end of a strip of hot-rolled material to one of the take-up machines;

moving at least one of said airflow suction strip passing devices, and at least one of said pinch roll introducing guides to a predetermined height above the line so that said airflow suction strip passing device draws the strip;

cutting the strip with a shearing device;

introducing a new leading edge of hot-rolled material into the take-up machines;

continuing to support the strip until a point the new leading edge is introduced.

18. A take-up method according to claim 15, further comprising the steps of:

providing a plurality of airflow suction strip passing devices disposable to draw a strip passing through the line by suction created by air flowing from the passing device;

holding said airflow suction strip passing devices away form said line;

leading a first leading end of a strip of hot-rolled material to one of the take-up machines;

moving at least one of said airflow suction strip passing devices, and at least one of said pinch roll introducing guides to a predetermined height above the line so that said airflow suction strip passing device draws the strip;

cutting the strip with a shearing device;

introducing a new leading edge of hot-rolled material into the take-up machines;

continuing to support the strip until a point the new leading edge is introduced.

* * * * *